United States Patent [19]

Eriksen

[11] Patent Number: 4,473,965

[45] Date of Patent: Oct. 2, 1984

[54] MUZZLE LOADER APPARATUS

[76] Inventor: Eric Eriksen, 215 S. Cortez St., New Orleans, La. 70119

[21] Appl. No.: 323,675

[22] Filed: Nov. 23, 1981

[51] Int. Cl.[3] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 3,747,252 | 7/1973 | Walker | 42/90 |
| 4,152,858 | 5/1979 | Dobbs | 42/90 |
| 4,229,897 | 10/1980 | Snowden | 42/90 |
| 4,327,515 | 5/1982 | Kuryn | 42/90 |

*Primary Examiner*—Charles T. Jordan
*Attorney, Agent, or Firm*—Thomas S. Keaty

[57] ABSTRACT

A muzzle loader apparatus for use with pistols, which have a curved handle and are loaded with lead balls. The apparatus has a handle engagement portion to house the handle of the pistol, this portion generally conforming to the shape of the handle. A support portion is fixedly connected to the handle portion and extends beyond the length of a barrel, so that a swivel arm can be mounted on the free end of the extended support portion. The swivel arm can move from a horizontal inoperative to a vertical operative position. A ramrod projector is swivelly mounted onto the swivel arm and can move to an alignment position with a bore of the pistol, when the swivel arm is in a position perpendicular to a longitudinal axis of the barrel of the pistol and the support portion. The swivel projector has a loading arm insertable into the pistol bore when the swivel arm is in the vertical operative position. During use, the swivel arm is first horizontally disposed, while a lead ball or patch are placed at the opening of the pistol bore. Then the swivel arm is moved to a vertical position, perpendicular to the longitudinal axis of the barrel, and the ramrod projector engages the lead ball and patch forcing them into the pistol bore. At this time, the handle portion serves as a counterforce of the swivel arm against the lead ball and the patch. The handle portion can be made of a flexible material in an alternative embodiment of the invention.

9 Claims, 7 Drawing Figures

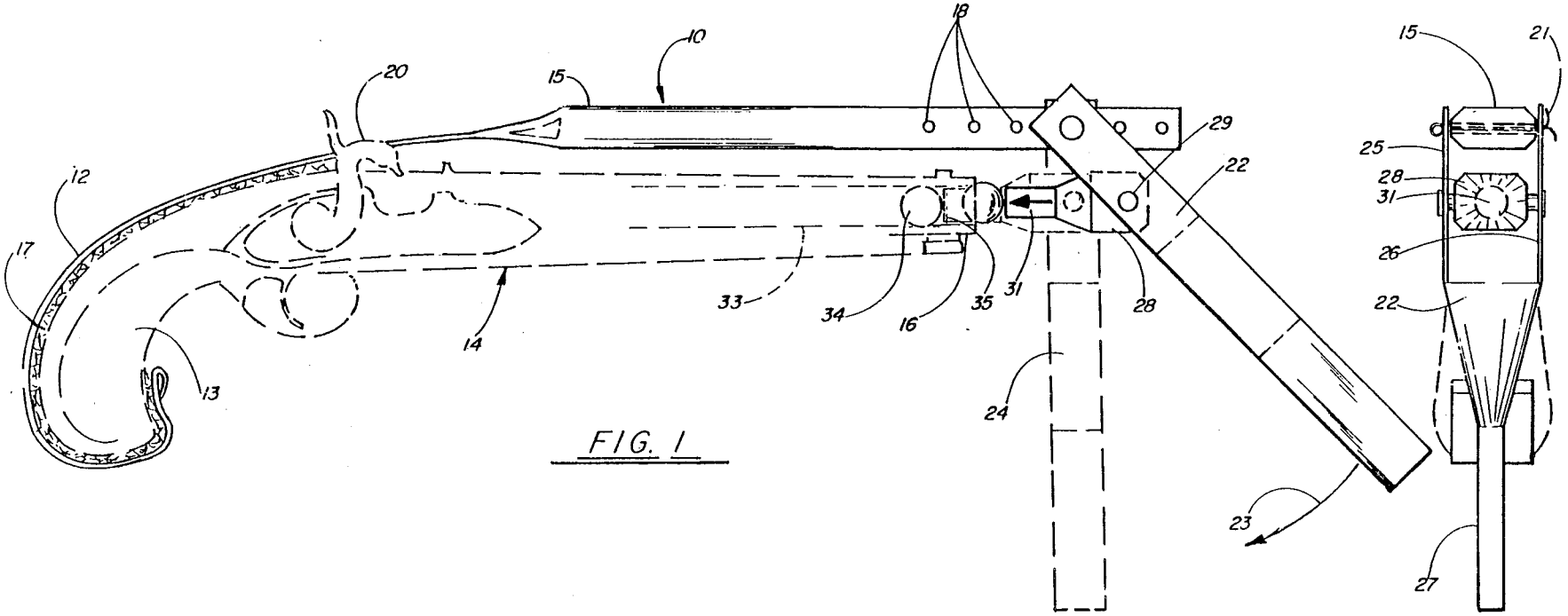
FIG. 3
FIG. 1
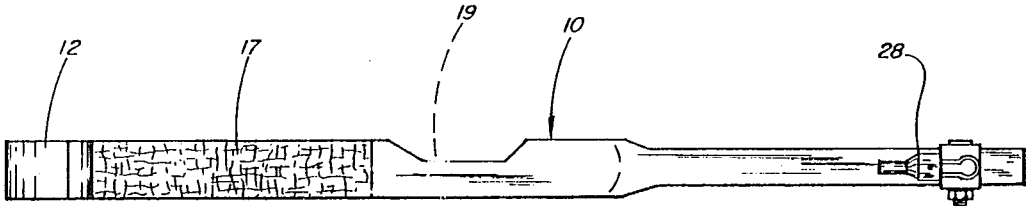
FIG. 2

MUZZLE LOADER APPARATUS

BACKGROUND OF THE INVENTION

1. Field of the Invention

The present invention relates to muzzle loading apparatuses. More particularly, the present invention relates to an apparatus for assisting in loading a muzzle loader fire arm, such as a pistol, with more ease and speed.

2. General Background

On the subject of firearms and the like, there has been a resurgence in the interest in antique firearms such as muzzle loader rifles and hand pistols. This resurgence has provided numerous individuals with the opportunity to become experienced in the use of these firearms, and, with that, to become familiar with the problems involved in preparing the individual firearms for firing, i.e. packing the powder and inserting the lead ball into the muzzle during the loading procedure.

As one may be familiar with at this point, one of the most common problems in the loading process is the placement of the lead ball into the barrel of the firearms. This is so because the lead ball along with patch by necessity, is somewhat slightly larger in diameter than the bore in the muzzle, so that the lead ball and patch, once forced into the muzzle, is impacted full force when the powder is exploded, and none of the energy escapes between the bore and the lead ball and patch. Therefore, because the lead ball is soft, the patch protects and becomes deformed in order to conform to the shape of the bore as it is forced into the bore. That being the case, as I had stated earlier, force must be placed upon the lead ball and patch in order to properly load it. In the loading of rifles or the like, the forcing of the lead ball and patch into the bore of the barrel is no problem due to the fact that the butt of the rifle may be placed against the ground or the like, and provides adequate stability in order to exert force against it.

However, in the loading of muzzle loading pistols, the designs of these antique pistols are such, that the handle portion slopes downward in a curvature so that the hand fits around the back of the handle with more comfort. However, due to this curvature of the handle, if one attempts to exert force upon the lead ball and patch by standing the pistol upright on its handle, the common problem is that the pistol will simply slip or rock out of position and the loading process becomes a frustrating attempt to maintain the pistol in the upright position in order to exert force in the direction of the handle for placement of the lead ball and patch within the barrel.

Several patents address the construction of apparatuses for assisting in the loading of pistols and rifles, the most pertinent being as follows:

U.S. Pat. No. 3,747,252 issued to B. Walker entitled "Musket Ball Insertion Tool" teaches the use of a tool for aligning and piloting a musket ball into the muzzle of the barrel of a musket. However, this particular patent does not address the problem of loading a curved handle muzzle loader pistol.

U.S. Pat. No. 4,207,698 issued to J. Burson entitled "Device for Loading Muzzle Loading Rifles and Method of Preparing the Device" teaches the use of a loading apparatus for a muzzle loading rifle. Again, this particular patent addresses the procedure of loading a musket rifle, and does not direct its attention to the problem of loading pistols.

U.S. Pat. No. 4,152,858 issued to H. Dobbs entitled "Fast Loader for Muzzle-Loader" teaches the use of an apparatus for forming a charge for a muzzle-loading gun and including a predetermined amount of powder and a bullet partially embraced within a patch. Again, the apparatus is designed particularly for use with a rifle, and does not address the problem as incurred with the loading of muzzle loader pistols.

U.S. Pat. No. 4,135,322 issued to Tice, et al entitled "Muzzle Charge Storage and Loading Accessory for Muzzle Loading Firearms" teaches the use of an accessory whereby you can store a single muzzle charge of powder, ball and percussion cap and for facilitating the rapid loading of the single charge into the muzzle loading fire arm.

The accessory is used primarily on the percussion cap for engagement with the percussion cap and not having to do same manually.

U.S. Pat. No. 4,094,098 issued to Gourley entitled "Loading Block for Muzzle Loading Gun" teaches the use of a block for loading the muzzle of a gun, including a plurality of spaced shot holes, each hole intercepting locator recess adapted to fit over the muzzle of a gun to be loaded. Again, this apparatus would be utilized primarily with a rifle and not with the pistol as the apparatus of the present invention.

U.S. Pat. No. 4,123,868 issued to Wilson entitled "Gun Powder Charge and projectile Container" would teach the use of a container for having a premeasured powder charge, a projectile and a percussion cap for quick use in reloading a muzzle loading firearm. The apparatus simply has the particular elements stored and does not really address the problem as the apparatus of the present invention would address with muzzle loading pistols.

U.S. Pat. No. 4,229,897 issued to Snowden entitled "Muzzle Loading Apparatus" teaches the use of an apparatus for rapid loading of a muzzle loaded rifle with a ball and premeasured quantity of powder. Again, this patent also only addresses the device in using a muzzle loading rifle.

U.S. Pat. No. 4,112,606 issued to Griffin entitled "Muzzle Loading Device" would teach the use of a device for carrying materials for muzzle loading firearms and would simply be a holding apparatus designed mainly to be utilized with a rifle and having a predetermined measured amount of powder, etc.

General Discussion of the Present Invention

The present invention would solve the problem as encountered in the present state of the art, and those shortcomings of the state of the art in a simple and inexpensive straightforward manner. The present invention would provide for an apparatus which would fascilitate easy and unencumbered loading of a muzzle loading pistol, in particular, that type of pistol which is basically the type having the curved handle and utilizing the lead ball or the like. The apparatus would include a means for encountering the handle portion of the pistol to be loaded at one end, and a support means on the second end, extending beyond the barrel length of the pistol, for mounting a swivelly mounted arm thereunto. The swivel arm would have swivelly mounted onto it a ramrod projection which would encounter the bore of the pistol as the swivel arm is moved into a position substantially perpendicular to the longitudinally disposed position of the support section of the apparatus. During use, the swivel arm of the apparatus would be substantially horizontally disposed while a lead ball or patch or the like would be placed at the opening of the bore of the pistol. Upon movement of the swivel arm into a perpendicular position, the ramrod portion would engage the lead ball and patch and, as the swivel portion is moved substantially perpendicular to the support arm, the ball and patch would be forced into the bore of the pistol to a predetermined distance. That portion of the apparatus engaging the handle of the pistol would serve as a means to apply force in towards the pistol, thus enabling the swivel arm to force the lead ball and patch into the bore of the muzzle loader. An additional embodiment of the apparatus may include a flexible means for engaging the handle end of the pistol rather than the somewhat rigid means as disclosed in the preferred embodiment.

Therefore, it is an object of the present invention to provide a simple and inexpensive apparatus for fascilitating the loading of a muzzle loader pistol.

It is a further object of the present invention to provide an apparatus for initiating the loading process in a muzzle loader pistol.

It is still a further object of the present invention to provide an apparatus which may be mounted onto a pistol and initiate the placement of a lead ball and patch in the bore of the barrel without having to rely on the pistol being mounted onto a stable surface.

It is still a further object of the present invention to provide an apparatus whereby a lead ball and patch may be placed into a curved handle muzzle loader pistol relying on the force between the handle end of the pistol and the loading end of the pistol.

To accomplish the above object, it is a feature of the present invention to provide an apparatus having a handle engaging portion and a loading portion, the two portions working against one another to provide force for injecting a lead ball and patch into the barrel of the pistol.

It is still a further feature of the apparatus to provide a swivel arm swivelly engaged to a ramrod projection portion for forcing a lead ball and patch into the barrel of the pistol upon movement of the swivel arm perpendicular to the support portion.

It is still a further feature of the apparatus to provide a ramrod projection swivelly mounted to a swivel arm, wherein the ramrod projection is inserted into the barrel of the pistol upon movement of the swivel arm toward the pistol itself.

BRIEF DESCRIPTION OF THE DRAWINGS

For a further understanding of the nature and object of the present invention, reference should be had to the following detailed description, taken in conjunction with the accompanying drawings, in which like parts are given like reference numerals and, wherein:

FIG. 1 is a side view of the preferred embodiment of the apparatus of the present invention, illustrating movement of the swivel arm and ramrod portion in phanthom.

FIG. 2 is a bottom view of the preferred embodiment of the apparatus of the present invention illustrating the notched portion of the apparatus for accommodating the hammer of the right handed pistol to be loaded.

FIG. 3 is a frontal view of the preferred embodiment of the apparatus of the present invention.

DETAILED DESCRIPTION OF THE PREFERRED EMBODIMENT

Figures 4, 5, 6, 7:
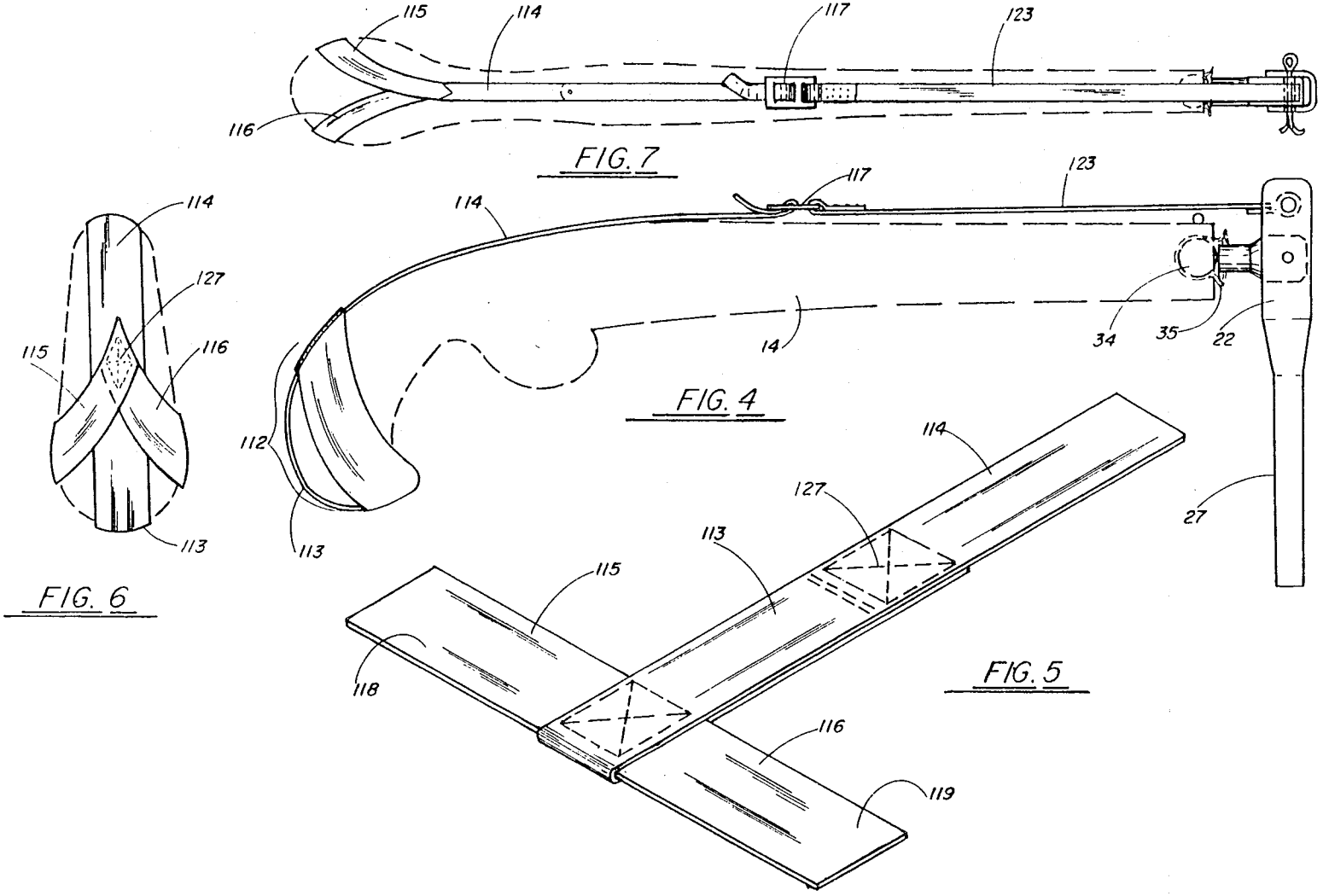
FIG. 4 is a side mounted view of an additional embodiment of the apparatus of the present invention.
FIG. 5 is a overall disassembled perspective view of an additional embodiment of the apparatus of the present invention.
FIG. 6 is a rear view of the handle engagement portion of an additional embodiment of the apparatus of the present invention.
FIG. 7 is a top mounted view of an additional embodiment of the apparatus of the present invention.

FIGS. 1 through 3 illustrate the preferred embodiment of the apparatus of the present invention generally designated by a numeral 10. Muzzle loader apparatus 10, as illustrated in FIG. 1, comprises handle engagement portion 12 which, in the preferred embodiment, would be comprised of a somewhat flexible metal strip substantially the width of the handle portion 13 of muzzle loader pistol 14, with the metal strip, as is illustrated in FIG. 1, conforming to the shape of the bottom under portion of the handle and further conforming somewhat to the under portion of the handle at least partially so that handle 13 would, in effect, be partially encased in handle engagement portion 12 once the apparatus has been placed upon muzzle loader pistol 14. In the preferred embodiment, the underside of handle engagement portion 12 would be lined with a soft material 17, such as felt or the like for eliminating the possibility of scratching the wooden handle of the muzzle loader during the loading operation once the apparatus has been placed upon the muzzle loader pistol 14.

As further illustrated in FIG. 1, handle portion 12 would extend into and be integrally attached to mounting section 15, which would extend substantially from the hammer portion of the pistol forward to the end distal to the handle portion extending somewhat beyond the muzzle end 16 of muzzle loader pistol 14. In the preferred embodiment, support portion 15 would be substantially made of metal and wood, and would be substantially the same width as handle engagement portion 12. As is further illustrated in FIG. 1, at the distal end area of support portion 15, would be a plurality of ports 18, each substantially half inch apart to accommodate the various length of muzzle loaders that may be loaded with this particular apparatus.

FIG. 2 illustrates apparatus 10 from a bottom view illustrating underlining felt 17 extending around the inner side of handle engagement portion 12, and notched area 19 which substantially conforms to the position of the hammer 20 of muzzle loader pistol 14, to accommodate the projection of hammer 20 above the plane of pistol 14 while the apparatus 10 is mounted thereupon. As is further illustrated in FIGS. 1 and 3 of the preferred embodiment of the apparatus, swivelly mounted onto support section 15, is swivel arm 22, which, as is illustrated in front view in FIG. 3 and side view in FIG. 1, is substantially a pair of projecting arms extending on either side of support section 15 and engaging through support section 15 with a cotter pin 21 or the like means so that swivel arm 22 is able to swivel along the course as illustrated by arrow 23 in FIG. 1, from a position substantially perpendicular as shown in phanthom view 24.

In the preferred embodiment, swivel arm 22 would be constructed of light weight metal or the like, having a bifurcated arm sections 25 and 26 which would bevel downward to handle portion 27 for engagement by the human hand or the like for swivelling arm 22 during the loading process.

As is further illustrated in FIG. 1, ramrod projection portion 28, which comprises a body portion 29, which has a bore therethrough for passage of a screw or the like for mounting between handle arm sections 25 and 26 of swivel arm 22, and having the ability itself to swivel between bifurcated arms 25 and 26. As is apparent from FIG. 1, it is essential that projection portion 28 has the ability to swivel in view of the fact that while the movement of swivel arm 22 from the vertical to the horizontal position, projection portion 28 must be maintained substantially in the horizontal direction to align itself with the bore of pistol 14 during the loading procedure. Projection portion 28 further comprises push rod portion 31, extending as an integral part of body portion 29, being of reduced diameter than body 29 for inserting into bore 33 of muzzle loader 14.

During the loading process, as is illustrated in phantom view in FIG. 1, lead ball 34 and patch 35 would be placed atop bore 33 of muzzle loader 14 either while pistol 14 is in the vertical or horizontal position. Apparatus 10 would be mounted thereupon pistol 14 with handle engagement portion 12 being placed around handle 13, and prior to the loading process, swivel arm 22 being in substantial alignment with support section 15. The movement of swivel arm 22 from the horizontal to the vertical position as shown in phantom 24 would impart movement of projection portion 28, with push rod portion 31 engaging lead ball 34 and patch 35 and exerting force on lead ball and patch 35 toward bore 33 of pistol 14. Upon further movement of handle 22 into a position substantially perpendicular to support portion 15, as is illustrated in phantom view in FIG. 1, that lead ball 34 and patch 35 would, in effect, be forced into the bore 33 of muzzle loader 14, with push portion 31 being inserted into the bore also through substantially its entire length. In the preferred embodiment, push rod portion 31 would be approximately ½ to ¾ inches in length. Thus the lead ball 34 being inserted substantially that amount of distance into bore 33 of muzzle loader 14.

It should be made clear that the apparatus 10 is adapted especially for fascilitating the insertion of lead ball 34 and patch 35 into bore 33 during the loading process. As was discussed earlier, the apparatus was intended primarily for overcoming the problem of initiating the movement or the placement of lead ball 34 and patch 35 within bore 33 due to the overall diameter of lead ball 34 and patch 35 being substantially greater than the diameter of bore 33, and there being a need to exert a certain amount of pressure to conform lead ball 34 to the shape of bore 33. Therefore, following the placement of lead ball 34 and patch 35 within bore 33 via apparatus 10, a conventional ramrod or the like would then be utilized for further placement of lead ball 34 and patch 35 into the bore 33 in contact with the powder, etc. for completing the loading process.

In the overall use of apparatus 10, it should be stressed that the handle engagement portion 12 serves as a means for enabling force to be imparted by swivel arm 22 and projection portion 28 against lead ball 34 and patch 35 during the loading process. Without the handle engagement section 12 serving to counteract the force in the direction of the lead ball 34 and patch 35, the apparatus would be totally nonfunctional and could not be utilized in the manner for which it is aimed.

FIGS. 4, 5, 6 and 7 illustrate an additional embodiment of apparatus 10. As illustrated in FIG. 4 through 7, the additional embodiment of apparatus comprises handle engagement portion 112 which would be a flexible pocket consisting of side panels 116 and 115 and rear panel 113, constructed of canvas or the like and cupped around handle 13 of pistol 14, as illustrated in FIG. 4 in side view and FIG. 6 in rear view. Extending upward along the top rear of pistol 14 is flexible panel 114 which would be adjustably buckled via buckle 117 to a forward extending panel 123, said forward extending panel directed to swivel arm 22, with swivel arm 22 being substantially the same type of construction as in the preferred embodiment.

Also, the remainder of the apparatus 10 would be identical to the preferred embodiment, with the only additional embodiment being the handle engagement section 112 being a flexible pocket or the like and an adjustable buckle 117 enabling the additional embodiment of the apparatus 10 to accommodate various lengths of pistols.

As is illustrated in FIG. 5 in disassembled view, handle engagement portion 112 would include rearward extending portion 113, which would be stitched to left and right engaging panels 115 and 116, also constructed of canvas or the like flexible material. In this embodiment, the end portions 118 and 119 of arms 115 and 116 respectively would be further stitched to the rearward extending portion 113 at point 127 to form a substantially three sided engagement pocket portion for engaging handle 13 of gun 14.

In this embodiment, as is illustrated in top view in FIG. 7, flexible portion 114 would extend the partial length of gun 14, and substantially midway the length of gun 14, flexible strap 114 would engage adjustable means 117, such as a buckle or the like that would allow adjustment of the overall length of rearward extending portion 114, with the second flexible length 123 extending forward from the buckle 117 to the swivel arm portion 22, and connectingly engaged to arm 22 via a pin or the like means, as is illustrated in side view in FIG. 5.

In this embodiment, this flexible handle engagement portion 112 would enable the apparatus to take up less space when not in use, would be less inclined to damage the stock of the pistol while mounting the apparatus 10 onto pistol 14 and would yet serve the identical purpose of serving as a means to impart force against the force of the swivel arm during loading of the lead ball 34 and patch 35 into pistol 14.

Because many varying and different embodiments may be made within the scope of the inventive concept herein taught, and because many modifications may be made in the embodiment herein detailed in accordance with the descriptive requirement of the law, it is to be understood that the details herein are to be interpreted as illustrative and not in a limiting sense.

I claim:

1. A muzzle loader loading apparatus, comprising:

a. handle engagement means;

b. support means, extending the length of a pistol to be loaded, and integrally connected at its first end to said handle engagement means;

c. loading means swivelly connected to the second end of said support means, said loading means further comprising:

i. a swivel arm portion, movable from substantially a horizontally inoperative position to a vertical operative position;

ii. a ramrod projection portion, swivelly mounted to said swivel arm portion, so that movement of said swivel arm portion from said horizontal inoperative position to said vertical operative position imparts movement of said ramrod projection portion substantially in alignment with a bore of the pistol to be loaded, said ramrod projection portion further having a loading arm insertable into the bore of said pistol when said swivel arm is in the vertical operative position;

d. whereby movement of said swivel arm toward a vertical position during the loading process imparts force from said ramrod projection portion onto a lead ball and patch insertable into the bore as said swivel means is moved into the vertical operative position, said handle engagement means serving as a counterforce of said swivel arm against said lead ball and patch.

2. The apparatus in claim 1, wherein said handle engagement means generally comprises a substantially extended piece of metal in the shape of a handle of the muzzle loader pistol to be loaded.

3. The apparatus in claim 1, wherein there is further provided means for allowing a hammer of said muzzle loader pistol to project above said support means during the loading process.

4. An apparatus for assisting loading a muzzle loader pistol comprising:

a. handle engagement means;

b. support means integrally connected to a first end of said handle engagement means;

c. loading means swivelly connected to a second end of said support means, said loading means swivelly mounted from substantially a horizontal inoperative position to a vertical operative position;

d. ramrod projection means, swivelly mounted to said loading means, wherein movement of said loading means from the horizontal to the vertical position imparts movement of said ramroad projection means into a bore of a gun to be loaded.

5. The apparatus in claim 4, wherein said ramrod projection means further comprises an end portion insertable into the bore of the pistol to be loaded.

6. The apparatus of claim 4, wherein said handle engagement means serves as a counterforce against said loading means when said loading means is in the vertical operative position, exerting force against a lead ball and patch to be loaded into the bore of said pistol.

7. An apparatus for assisting loading a muzzle loader comprising:

a. flexible handle engagement means;

b. flexible support means connected to said handle engagement means and extending substantially the length of a pistol to be loaded;

c. loading means swivelly connected to said flexible support means, said loading means swivelly mounted from substantially a horizontal inoperative position to a vertical operative position;

d. ramrod projection means swivelly mounted to said loading means, wherein movement of said loading means from a horizontal to a vertical position imparts movement of said ramrod projection means into a bore of a gun to be loaded; and wherein said handle engagement means serves as a counterforce against said loading means when said loading means is in the vertical operative position, exerting force against a lead ball and patch to be loaded into the bore of the pistol.

8. The apparatus of claim 7, wherein the flexible handle engagement means comprises a three sided pocket for insertion of a handle of the muzzle loader pistol into said pocket.

9. The apparatus in claim 7, wherein the connection between the flexible handle engagement means and the flexible support means comprises an adjustable interlocking buckle means.

* * * * *